US005887291A

United States Patent [19]

Bellizzi

[11] Patent Number: 5,887,291

[45] Date of Patent: Mar. 30, 1999

[54] SANITARY TOILET SEAT ATTACHABLE COVER

[76] Inventor: Darren Bellizzi, 3040 Constitution Blvd., Mississauga, Ontario, Canada, L4Y 3X7

[21] Appl. No.: 70,566

[22] Filed: Apr. 30, 1998

[51] Int. Cl.[6] ..... A47K 13/14

[52] U.S. Cl. ..... 4/245.5; 4/245.7; 4/245.9

[58] Field of Search ..... 4/245.1, 245.3, 4/245.5, 245.7–245.9

[56] References Cited

U.S. PATENT DOCUMENTS

| | | | |
|---|---|---|---|
| 1,159,070 | 11/1915 | Munch | 4/245.5 |
| 1,635,072 | 7/1927 | De Luna | 4/245.3 |
| 3,102,276 | 9/1963 | Warnberg | 4/245.5 |
| 4,589,149 | 5/1986 | Bassi | 4/245.5 |
| 5,745,929 | 5/1998 | Sobieralski | 4/245.1 |

FOREIGN PATENT DOCUMENTS

| | | | |
|---|---|---|---|
| 2590788 | 6/1987 | France | 4/245.3 |
| 503660 | 1/1956 | Italy | 4/245.1 |
| 2227503 | 8/1990 | United Kingdom | 4/245.3 |

*Primary Examiner*—Charles R. Eloshway

[57] ABSTRACT

A new sanitary toilet seat attachable cover for allowing a person to sit on a toilet without having to sit directly on a toilet seat. The device includes a circular plastic ring dimensioned for covering a toilet seat of a toilet. The circular plastic ring is defined by an outer periphery and an inner periphery. The outer periphery has an elastic band extending therearound with the outer periphery secured thereover for containment of the elastic band therewithin. The outer periphery is positionable on an outer peripheral edge of the toilet seat with the elastic band engaging an underside of the toilet seat inwardly of its outer peripheral edge.

2 Claims, 2 Drawing Sheets

FIG. 1
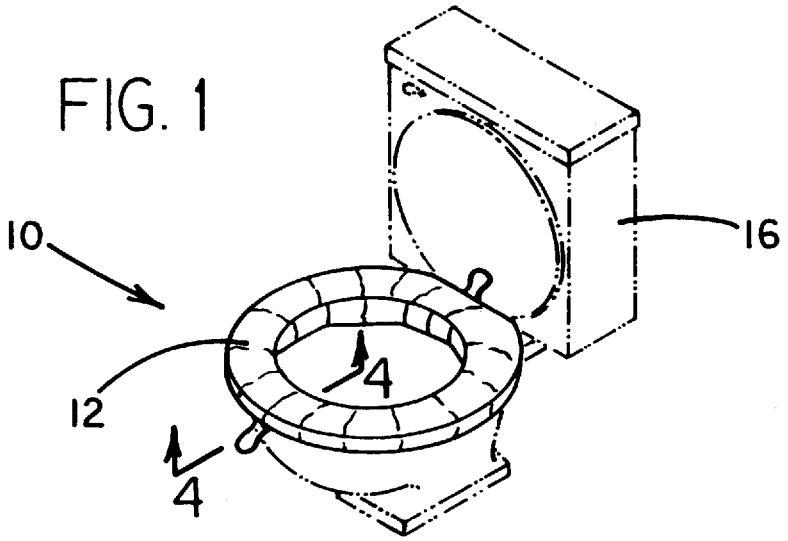
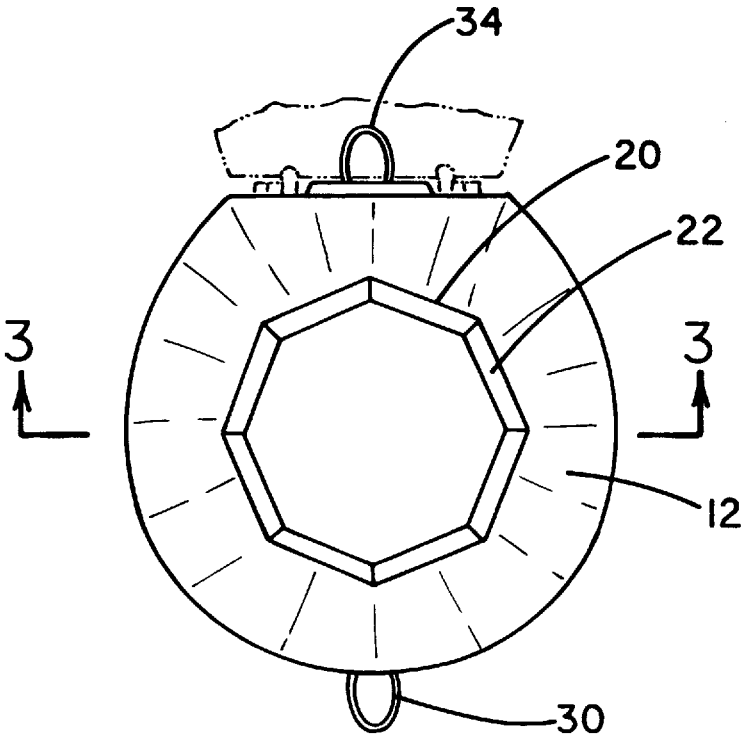
FIG. 2

SANITARY TOILET SEAT ATTACHABLE COVER

BACKGROUND OF THE INVENTION

1. Field of the Invention

The present invention relates to toilet seat covers and more particularly pertains to a new sanitary toilet seat attachable cover for allowing a person to sit on a toilet without having to sit directly on a toilet seat.

2. Description of the Prior Art

The use of toilet seat covers is known in the prior art. More specifically, toilet seat covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art toilet seat covers include U.S. Pat. No. 4,589,149 to Bassi; U.S. Pat. No. 4,227,267 to Robertson; U.S. Pat. No. 4,806,406 to Akerman et al.; U.S. Pat. No. 4,352,214 to Belz; U.S. Pat. No. 4,649,575 to Blair et al.; and U.S. Pat. No. Des. 323,027 to Sanders et al.

While these devices fulfill their respective, particular objectives and requirements, the aforementioned patents do not disclose a new toilet cover. The inventive device includes a circular plastic ring dimensioned for covering a toilet seat of a toilet. The circular plastic ring is defined by an outer periphery and an inner periphery. The outer periphery has an elastic band extending therearound with the outer periphery secured thereover for containment of the elastic band therewithin. The outer periphery is positionable on an outer peripheral edge of the toilet seat with the elastic band engaging an underside of the toilet seat inwardly of its outer peripheral edge.

In these respects, the sanitary toilet seat attachable coveraccording to the present invention substantially departs from the conventional concepts and designs of the prior art, and in so doing provides an apparatus primarily developed for the purpose of allowing a person to sit on a toilet without having to sit directly on a toilet seat.

SUMMARY OF THE INVENTION

In view of the foregoing disadvantages inherent in the known types of toilet seat covers now present in the prior art, the present invention provides a new sanitary toilet seat attachable coverconstruction wherein the same can be utilized for allowing a person to sit on a toilet without having to sit directly on a toilet seat.

The general purpose of the present invention, which will be described subsequently in greater detail, is to provide a new sanitary toilet seat attachable cover apparatus and method which has many of the advantages of the toilet seat covers mentioned heretofore and many novel features that result in a new sanitary toilet seat attachable cover which is not anticipated, rendered obvious, suggested, or even implied by any of the prior art toilet seat covers, either alone or in any combination thereof.

To attain this, the present invention generally comprises a circular plastic ring dimensioned for covering a toilet seat of a toilet. The circular plastic ring is defined by an outer periphery and an inner periphery. The inner periphery is defined by a plurality of downwardly extending flaps. The downwardly extending flaps cover an inner peripheral edge of the toilet seat when in use. The outer periphery has an elastic band extending therearound with the outer periphery secured thereover for containment of the elastic band therewithin. The outer periphery is positionable on an outer peripheral edge of the toilet seat with the elastic band engaging an underside of the toilet seat inwardly of its outer peripheral edge. A forward loop is secured to and extends outwardly from a forward portion of the circular plastic ring. The forward loop has an inner portion secured to the outer periphery and the elastic band thereof. A rearward loop is secured to and extends outwardly from a rearward portion of the circular plastic ring. The rearward loop has an inner portion secured to the outer periphery and the elastic band thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sanitary toilet seat attachable cover apparatus and method which has many of the advantages of the toilet seat covers mentioned heretofore and many novel features that result in a new sanitary toilet seat attachable cover which is not anticipated, rendered obvious, suggested, or even implied by any of the prior art toilet seat covers, either alone or in any combination thereof.

It is another object of the present invention to provide a new sanitary toilet seat attachable cover which may be easily and efficiently manufactured and marketed.

It is a further object of the present invention to provide a new sanitary toilet seat attachable cover which is of a durable and reliable construction.

An even further object of the present invention is to provide a new sanitary toilet seat attachable cover which is susceptible of a low cost of manufacture with regard to both materials and labor, and which accordingly is then susceptible of low prices of sale to the consuming public, thereby making such sanitary toilet seat attachable cover economically available to the buying public.

Still yet another object of the present invention is to provide a new sanitary toilet seat attachable cover which provides in the apparatuses and methods of the prior art some of the advantages thereof, while simultaneously overcoming some of the disadvantages normally associated therewith.

Still another object of the present invention is to provide a new sanitary toilet seat attachable coverfor allowing a person to sit on a toilet without having to sit directly on a toilet seat.

Yet another object of the present invention is to provide a new sanitary toilet seat attachable cover which includes a circular plastic ring dimensioned for covering a toilet seat of a toilet. The circular plastic ring is defined by an outer periphery and an inner periphery. The outer periphery has an elastic band extending therearound with the outer periphery secured thereover for containment of the elastic band therewithin. The outer periphery is positionable on an outer peripheral edge of the toilet seat with the elastic band engaging an underside of the toilet seat inwardly of its outer peripheral edge.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new sanitary toilet seat attachable cover according to the present invention.

FIG. 2 is a top plan view of the present invention illustrated in use.

DESCRIPTION OF THE PREFERRED EMBODIMENT

Figure 3:
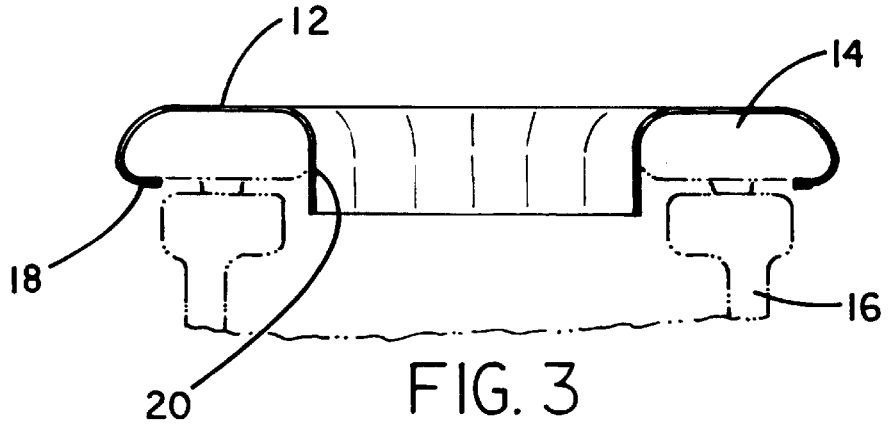
FIG. 3 is a cross-sectional view of the present invention as taken along line 3—3 of FIG. 2.
Figure 4:
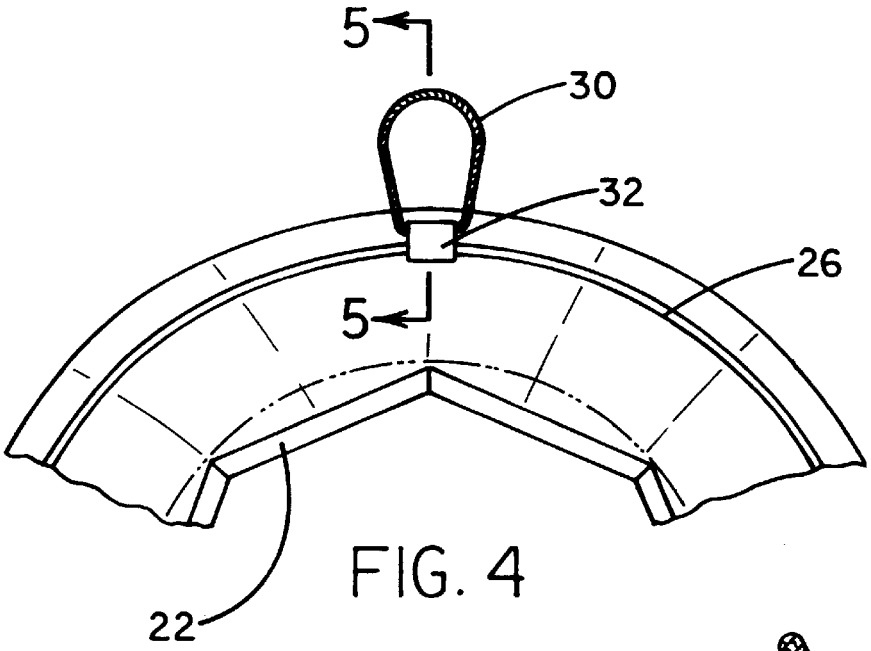
FIG. 4 is a cross-sectional view of the present invention as taken along line 4—4 of FIG. 1.
Figure 5:
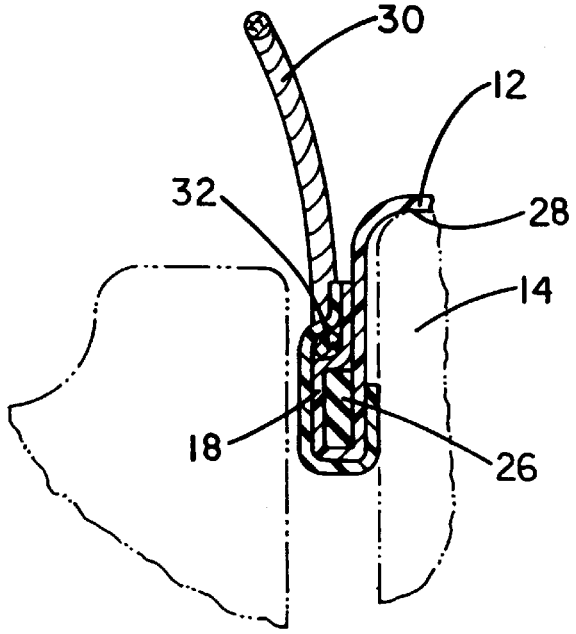
FIG. 5 is a cross-sectional view of the present invention as taken along line 5—5 of FIG. 4.

With reference now to the drawings, and in particular to FIGS. 1 through 5 thereof, a new sanitary toilet seat attachable cover embodying the principles and concepts of the present invention and generally designated by the reference numeral 10 will be described.

As best illustrated in FIGS. 1 through 5, the sanitary toilet seat attachable cover 10 comprises a circular plastic ring 12 dimensioned for covering a toilet seat 14 of a toilet 16. The circular plastic ring 12 is defined by an outer periphery 18 and an inner periphery 20. The inner periphery 20 is defined by a plurality of downwardly extending flaps 22. The downwardly extending flaps 22 cover an inner peripheral edge 24 of the toilet seat 14 when in use. The outer periphery 18 has an elastic band 26 extending therearound with the outer periphery 18 secured thereover for containment of the elastic band 26 therewithin. The outer periphery 18 is positionable on an outer peripheral edge 28 of the toilet seat 14 with the elastic band 26 engaging an underside of the toilet seat 14 inwardly of its outer peripheral edge 28.

A forward loop 30 is secured to and extends outwardly from a forward portion of the circular plastic ring 12. The forward loop 30 has an inner portion 32 secured to the outer periphery 18 and the elastic band 26 thereof.

A rearward loop 34 is secured to and extends outwardly from a rearward portion of the circular plastic ring 12. The rearward loop 34 has an inner portion secured to the outer periphery 18 and the elastic band 26 thereof.

In use, the present invention is a specially designed sanitary cover that would protect a person from germs and infections while using a public toilet. The device 10 consists of a cover or circular plastic ring 12 that would be attached to the toilet seat 14 with an elastic band 26 and forward 30 and rearward loops 34 that are used for removal of the circular plastic ring 12 from the toilet seat 14. The user would simply place the ring 12 on top of the toilet seat 14, and it would be secured with the elastic band 26. It would allow a person to use the toilet without sitting directly on the toilet seat 14. After using the toilet, the user would simply remove the circular ring 12 by pulling out and up on either the forward loop 30 or the rearward loop 34 and then dispose of it into the garbage. The device 10 would ensure that urine, germs, and moisture that collect on the toilet seat 14 would not touch the user's skin. Before, every use, a person would simply place the device 10 on top of the toilet seat 14 it and would conform to the seat 14 and it would be precluded from moving by the elastic band 26 once the user sits.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new sanitary toilet seat attachable cover for allowing a person to sit on a toilet without having to sit directly on a toilet seat comprising, in combination:

a circular plastic ring dimensioned for covering a toilet seat of a toilet, the circular plastic ring being defined by an outer periphery and an inner periphery, the inner periphery taking the shape of a polygon with a plurality of linear edges and being defined by a plurality of downwardly extending flaps each connected to and extending downwardly from one of the edges of the polygon, the downwardly extending flaps covering an inner peripheral edge of the toilet seat when in use, the outer periphery having an elastic band extending therearound with the outer periphery of the ring folded upon itself for defining a sleeve for containment of the elastic band therewithin, the outer periphery positionable on an outer peripheral edge of the toilet seat with the elastic band being adapted for engaging an underside of the toilet seat inwardly of the outer peripheral edge thereof;

a forward loop secured to and extending outwardly from the forward portion of the circular plastic ring, the forward loop having an inner portion secured to the outer periphery by way of a strip which is attached at a point inward of the outer periphery of the ring such that the strip encompasses opposite sides of the band and extends to the outer periphery to define a hole between the outer periphery of the ring and the sleeve in which the forward loop is secured; and a rearward loop secured to and extending outwardly from a central extent of the rearward portion of the circular plastic ring, the rearward loop having an inner portion secured to the outer periphery wherein the loops extend outwardly from the toilet seat when the ring is selectively mounted on the toilet seat.

2. A new sanitary toilet seat attachable cover system comprising, in combination:

a toilet with a bowl portion with an upper peripheral edge and a seat hingably coupled to the bowl portion;

a circular plastic ring covering the toilet seat of the toilet, the circular plastic ring being defined by an outer periphery and an inner periphery, the inner periphery taking the shape of a polygon with a plurality of linear edges and being defined by a plurality of downwardly extending flaps each connected to and extending downwardly from one of the edges of the polygon, the downwardly extending flaps covering an inner peripheral edge of the toilet seat and extending downwardly past the upper peripheral edge of bowl portion of the toilet, the outer periphery having an elastic band extending therearound with the outer periphery of the ring folded upon itself for defining a hole for containment of the elastic band therewithin, the outer periphery positioned on an outer peripheral edge of the toilet seat with the elastic band engaging an underside of the toilet seat inwardly of the outer peripheral edge thereof;

a forward loop secured to and extending outwardly from the forward portion of the circular plastic ring, the forward loop having an inner portion secured to the outer periphery by way of a strip which is attached at a point inward of the outer periphery of the ring such that the strip encompasses opposite sides of the band and extends to the outer periphery to define a hole between the outer periphery of the ring and the hole for containment of the elastic band in which the forward loop is secured; and a rearward loop secured to and extending outwardly from a central extent of the rearward portion of the circular plastic ring, the rearward loop having an inner portion secured to the outer periphery;

wherein the loops extend outwardly from the toilet seat;

wherein a portion of the strips of the loops are positioned between the band and the toilet seat.

* * * * *